US006036874A

United States Patent [19]

Farnaam

[11] Patent Number: 6,036,874

[45] Date of Patent: Mar. 14, 2000

[54] METHOD FOR FABRICATION OF NOZZLES FOR INK-JET PRINTERS

[75] Inventor: Kambiz Farnaam, Danville, Calif.

[73] Assignee: Applied Materials, Inc., Santa Clara, Calif.

[21] Appl. No.: 08/960,862

[22] Filed: Oct. 30, 1997

[51] Int. Cl.[7] ..... B11B 5/27

[52] U.S. Cl. ..... 216/27; 216/39; 216/56

[58] Field of Search ..... 216/27, 56, 39

[56] References Cited

U.S. PATENT DOCUMENTS 5,752,303 5/1998 Thiel ..... 216/27

*Primary Examiner*—Edward J. Cain

*Attorney, Agent, or Firm*—Townsend and Townsend and Crew LLP

[57] ABSTRACT

A method for forming a nozzle structure, as may be used in an ink-jet printer head, including first forming a layer of mold material on a substrate. The layer of mold material is shaped into a mold using photolithography and at least one etching step. A layer of nozzle material is then formed over the shaped mold material and the substrate. An aperture is formed through the nozzle material to the mold material, and the mold material is removed, leaving a chamber within the mold material; the chamber and aperture forming a nozzle structure.

26 Claims, 9 Drawing Sheets

Fig. 1A
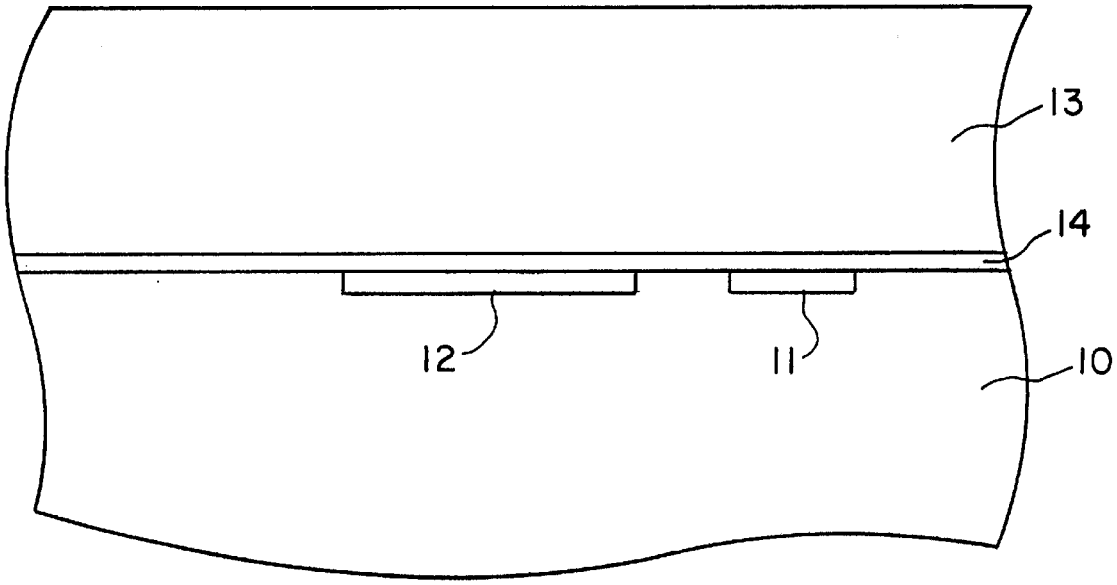
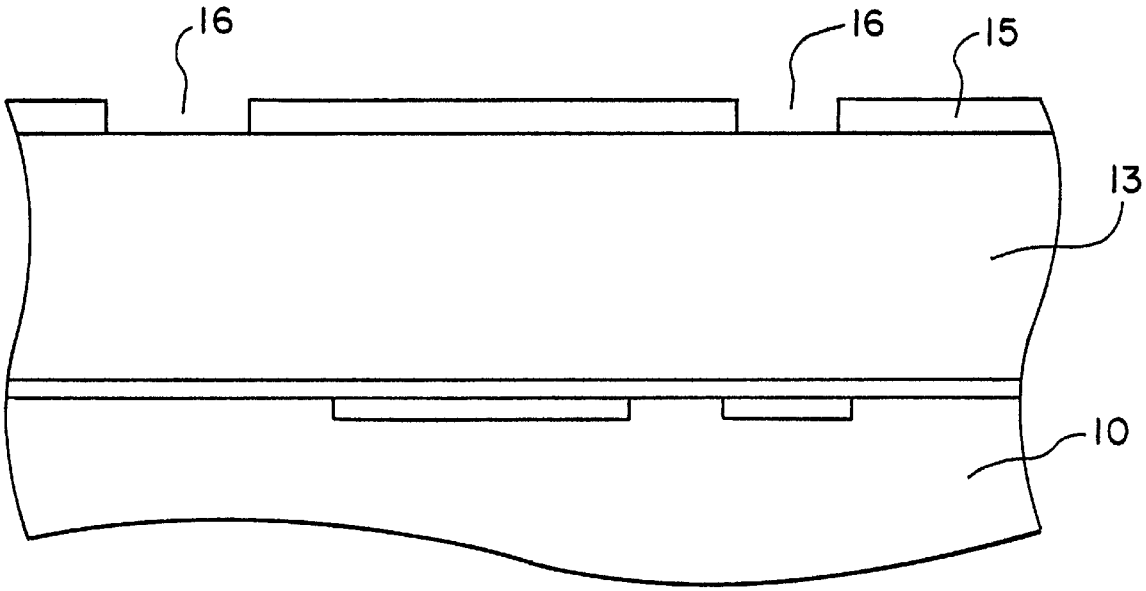
Fig. 1B

Fig. 1F
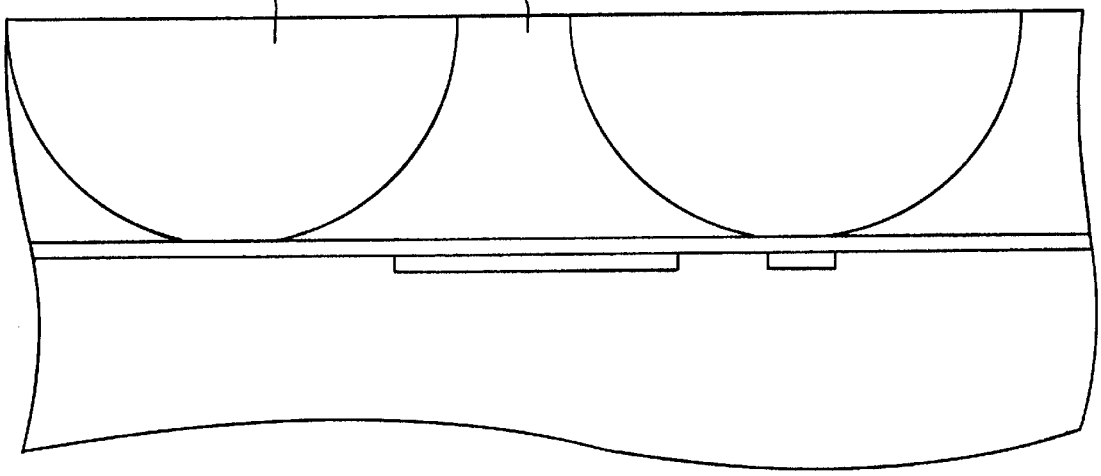
Fig. 1G
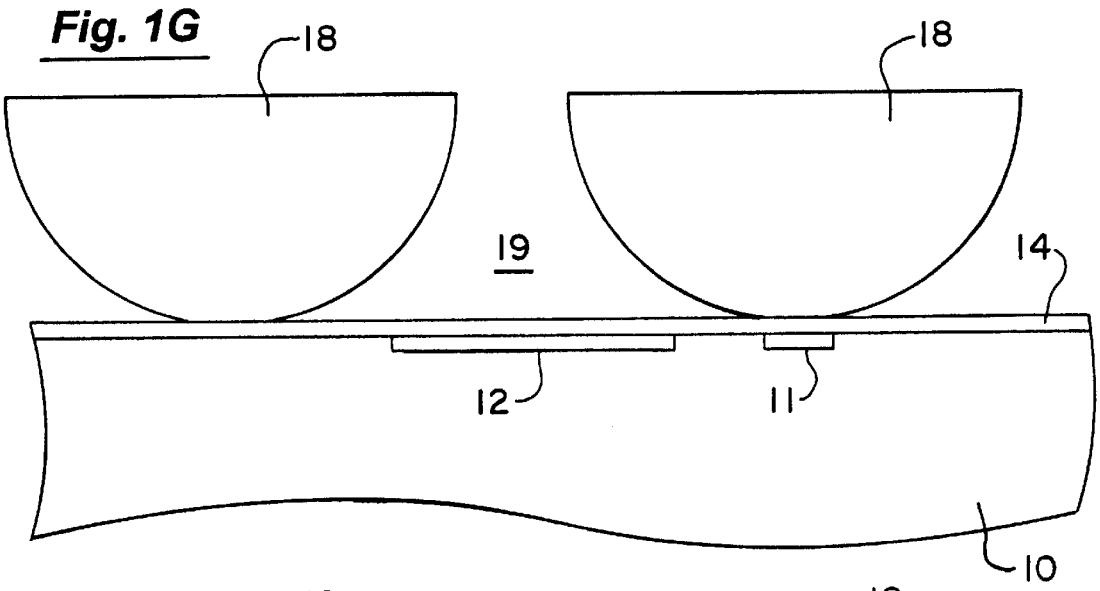
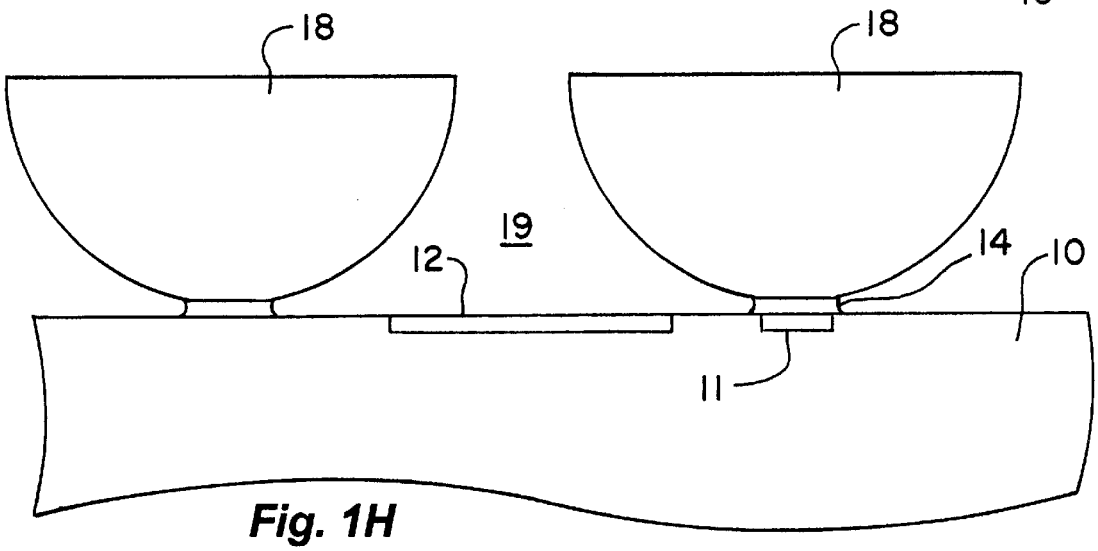
Fig. 1H

Fig. 3A
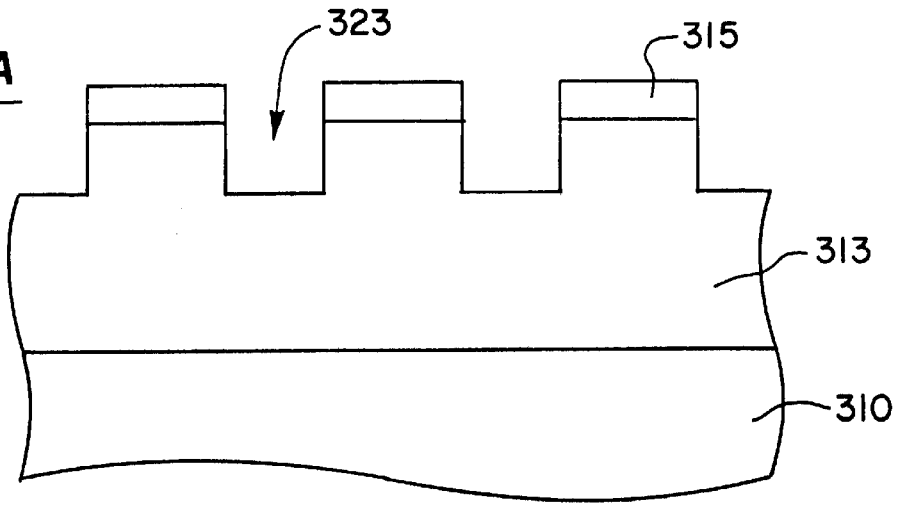
Fig. 3B
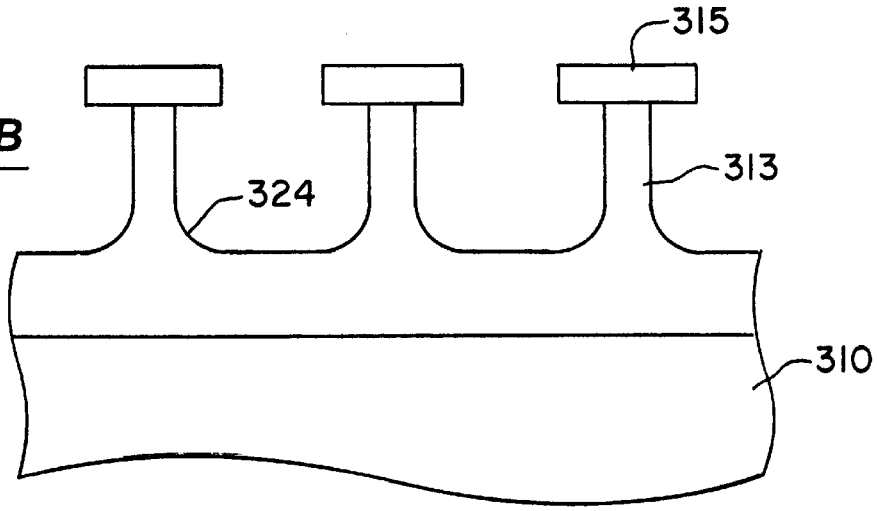
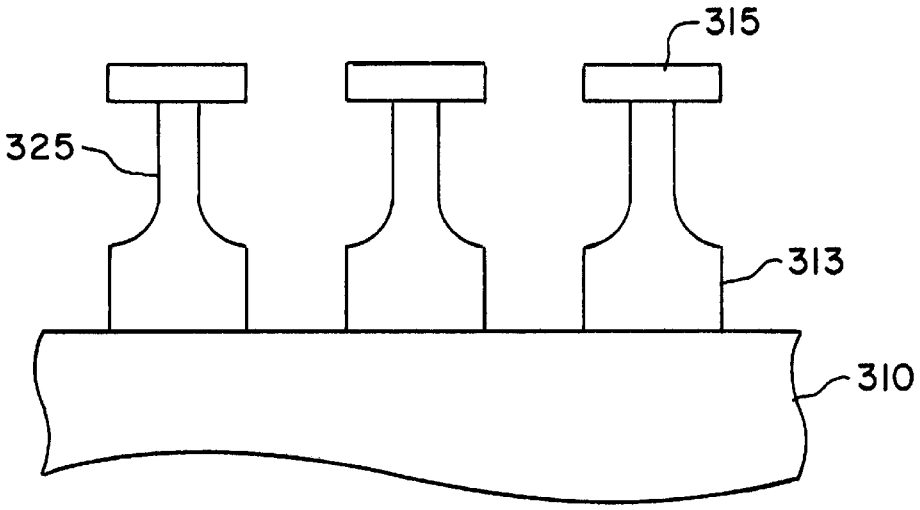
Fig. 3C

Fig. 5A
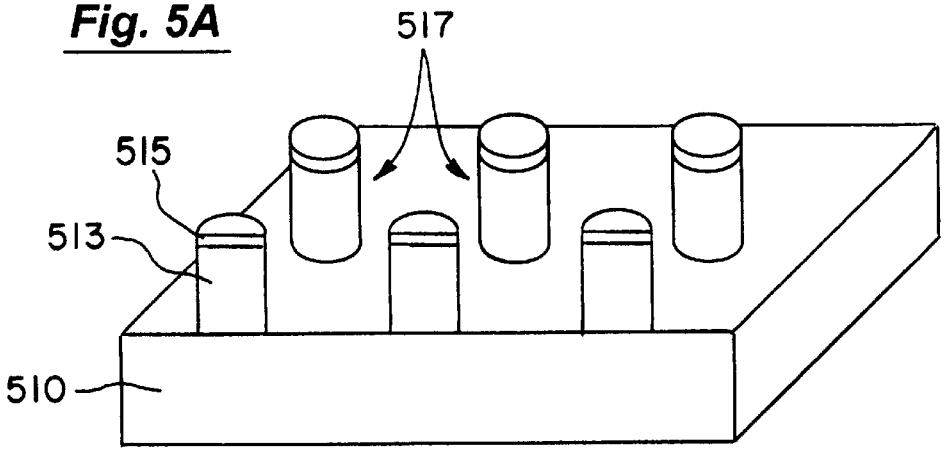
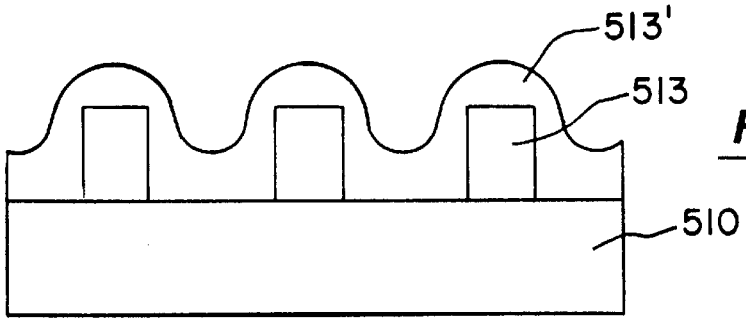
Fig. 5B
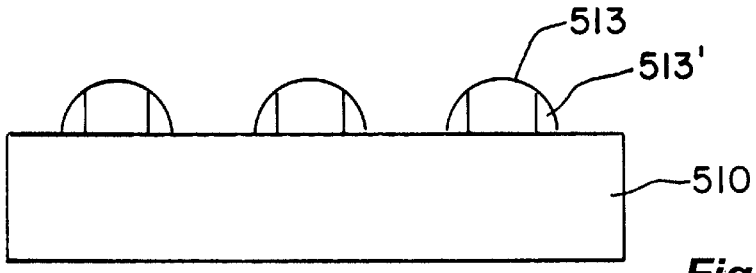
Fig. 5C
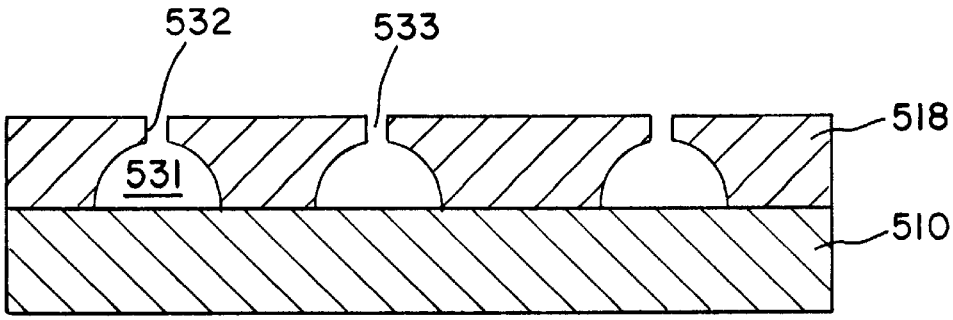
Fig. 5D

METHOD FOR FABRICATION OF NOZZLES FOR INK-JET PRINTERS

BACKGROUND OF THE INVENTION

The present invention relates generally to a method of fabricating a shaped void, or chamber, in a material using a consumable mold material, and in particular to a method for forming an ink-jet nozzle and ink chamber in a layer of nozzle material.

Ink-jet technology is used in many applications. One of the more familiar applications of ink-jet technology is in computer-controlled printers. It is generally desirable that ink-jet printers produce high-quality documents at an acceptable rate of printing. An ink-jet pen, or print head, has an array of nozzles that print in a swath as the print head is moved relative to the paper. Print quality is at least partially determined by the number and size of the ink-jet nozzles in the print head, smaller nozzles providing superior print quality, while a greater number of nozzles allows a wider print swath, resulting in higher printing speed.

It is also desirable that the print quality does not degrade from the nozzle wearing over the life of the ink-jet print head, and that the total cost per page be comparable to competing print technologies. To maintain print quality, some ink-jet printers use disposable print heads with a fixed amount of ink, designed such that the ink runs out before the nozzles degrade at an unacceptable level. Utilizing a disposable print head generates waste and increases the total cost per page of an ink-jet printer.

The nozzles are typically connected to an ink supply, or reservoir. In some instances, channels, capillaries, or conduits bring ink into a chamber beneath the nozzle opening, or aperture. Upon a command from the printer controller, the ink is expelled through the nozzle aperture onto a page of paper or other print media.

Various ink drivers may be used to expel the ink. For example, in some printers, an electric heating element, such as a thin-film resistor, heats the ink in the nozzle chamber to vaporize (boil) a portion of the ink, forming a bubble. The bubble causes some liquid ink within the nozzle chamber to be ejected out of the nozzle aperture. When the heating element is turned off, typically after only a few microseconds, the bubble collapses and nozzle chamber refills with ink. The collapse of the bubble can create large local pressures, up to 130 atmospheres, known as cavitation, within the chamber. The effects of the cavitation, which can include damage to the chamber and to the heating element, depend to at least some degree on the configuration of the chamber and aperture.

In other printers, a piezoelectric element is used to expel ink from the nozzle. The piezoelectric element changes dimensions in response to an applied electric field, and can create a pressure within the ink chamber to expel ink out the nozzle aperture.

The nozzle shape is important in determining the ink droplet size and velocity, the response of the ink driver, which may affect the printing speed, the durability of the ink driver, the durability of the nozzle, and other aspects of the ink-jet printer. Many different approaches have been used to fabricate ink-jet nozzles of suitable shape. Some approaches have used multi-step electroplating to form ink cavities and nozzles. Ink-jet nozzles have also been formed using lasers to ablate a polymer nozzle material deposited on a substrate. Other approaches rely on the anisotropic etching characteristics of single-crystal materials to form a chamber shape. For example, a {100} single crystal silicon substrate may be patterned with a masking material and etched with a solution, such as potassium hydroxide solution, to form a recess in the {100} substrate bounded by {111} side walls. The {100} substrate is then bonded to another substrate that contains the ink driver after aligning the nozzle to the ink driver.

There are at least three problems arising from the above process and similar processes. First, bonding the nozzle substrate to the ink driver substrate requires precise alignment of the nozzles to the ink drivers. Second, the resultant chamber shape is limited to the anisotropic etching characteristic of the material, in the above case the {111} faces, and may not be optimum for nozzle performance. Third, the process is restricted to single crystalline materials that exhibit anisotropic etching characteristics. These materials may not be the best choice for a nozzle material. For example, they may wear out too fast, especially when used with color inks that may contain anionic (sulfonated) dies and solvents.

Therefore, it is desirable to form nozzle apertures and nozzle chambers in a material that is compatible with color inks and other liquids. It is further desirable that the nozzle chamber is suitably shaped for use in an ink-jet print head or other jet device, and that the shape of the resulting nozzle chamber may be varied according to process controls to optimize nozzle performance.

SUMMARY OF THE INVENTION

The present invention provides methods for forming a nozzle structure, as may be used in an ink-jet printer head, and a device formed according to a method of the present invention. The method includes first forming a layer of mold material on a substrate. The layer of mold material is shaped into a mold using photolithography and at least one etching step. A layer of nozzle material is then formed over the shaped mold material and the substrate. An aperture is formed through the nozzle material to the mold material, and the mold material is removed, leaving a chamber within the mold material. The material surrounding the chamber and aperture defines a nozzle structure.

In one embodiment, amorphous or polycrystalline silicon is used as the mold material. A protective, or etch-stop, layer of silicon nitride is preferably formed over a silicon substrate before depositing the layer of mold material. In an ink-jet nozzle embodiment, the silicon substrate has pre-existing surface features, such as resistively heated ink-jet drivers and integrated control circuitry. Photoresist is patterned on the mold material, and the mold material is isotropically etched, preferably with plasma species produced in a remote plasma source (RPS). This isotropic etch undercuts the photoresist and forms the mold material into a suitable shape. The photoresist is stripped, and a layer of silicon oxide is deposited over the shaped mold material. The silicon oxide, which will form the nozzles, is planarized to expose an upper surface of the shaped mold material. The shaped mold material is then removed, leaving behind a chamber in the silicon oxide with essentially the same shape as the mold. A subsequent etch step removes the protective layer at the bottom of the chamber, exposing the surface structures.

In another embodiment, the isotropic etch is stopped before the protective layer is exposed. A biased plasma anisotropic etch is performed to remove mold material not shadowed by the photoresist cap. This opens essentially straight-sided channels to the protective layer. The resultant chamber has a relatively large volume and narrow, small radius aperture.

In another embodiment, a cylinder of mold material is formed on the substrate by photolithographic methods and biased-plasma etching. After stripping the photoresist, sputter etching forms a conical facet on the cylinder of mold material.

In another embodiment, a first layer of mold material is deposited on the substrate. The first layer of mold material is patterned into cylinders, and a second, conformal layer of mold material is formed over the first mold material and the substrate. An isotropic plasma etch is performed to etch the multiple layer of mold material down to the substrate or to an etch stop layer. The mold material may be overetched to produce hemispherical mold shapes.

These and other embodiments of the present invention, as well as its advantages and features are described in more detail in conjunction with the text below and attached figures.

BRIEF DESCRIPTION OF THE DRAWINGS

FIGS. 1A–1H are simplified cross sections of a nozzle being formed on a substrate according to one embodiment of the present invention;

FIGS. 3A–3C are simplified cross sections of a nozzle mold being formed on a substrate according to another embodiment of the present invention using anisotropic and isotropic etch steps;

FIGS. 5A–5D are simplified cross sections of a nozzle being formed on a substrate using multiple mold material depositions and an isotropic etch.

DESCRIPTION OF SPECIFIC EMBODIMENTS

Figure 1C:
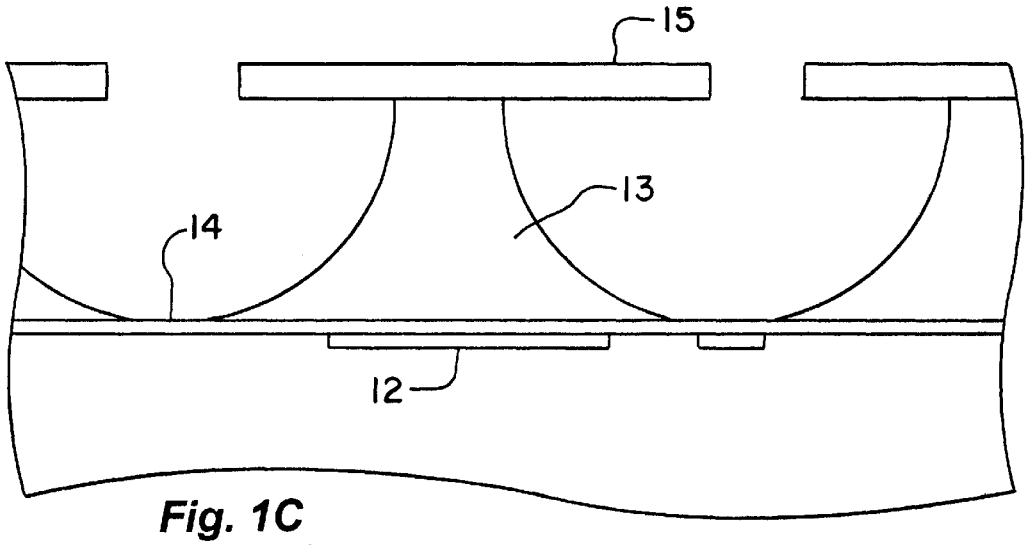

Several embodiments of the invention will now be described with reference to the above figures. In each case, a consumable mold is formed on a substrate by an etching process. A layer of material is formed over the mold. A portion of the mold material is exposed, and the mold material is removed, leaving a void, or chamber, in the layer of material in the same shape as the mold, and an aperture through the layer of material. In some instances, additional processing steps may further modify the shape of the chamber and aperture.

FIGS. 1A–1H show cross sections of a substrate 10 being processed according to one embodiment of the present invention. It is understood that the figures are not to scale and are for exemplary purposes only. FIG. 1J is a flow chart illustrating the process described in conjunction with FIGS. 1A–1H. The substrate is a silicon wafer and includes surface structures 11, 12 that are formed in or on the substrate prior to forming a layer of mold material 13, and may be electrically connected or integrated. For example, the surface structures may include a thin-film resistive heater, located as shown for surface structure 12, and transistor logic and drive circuitry, located as shown for surface structure 11. The location or inclusion of these surface structures is for illustration purposes only.

The surface structures may be electrically coupled together with conductive traces (not shown). For example, a thin film resistive heater or other ink driver, such as surface structure 12, may be coupled to an integrated driver control drive circuit, such as surface structure 11. The drive control circuit may be coupled to more than one ink driver and would actuate the appropriate ink driver or drivers to expel ink upon receiving a signal from a printer controller, for example.

Incorporating driver control circuitry on the same chip as the nozzles reduces the number of interconnect lines from the printer controller to the print head. For example, a print head with 50 nozzles that are driven directly by a printer controller might have 54 interconnections between the printer controller and the print head. A print head with 104 nozzles might require 112 interconnections for directly driving each nozzle. However, a print head with up to 308 nozzles required only 36 interconnections when an ink driver control circuit is integrated on the chip with the nozzles. The bonding pads required for the interconnections consume chip area. Therefore, reducing the number of interconnections reduces chip size and increases the yield of print head chips per wafer.

An optional protective layer 14 may be formed over the substrate and surface structures prior to forming the layer of mold material. The protective layer may protect the surface features from subsequent processing steps, or may act as an etch stop or otherwise affect the final shape of the void. An etch stop can affect the shape of the void by truncating the etch against the etch-stop layer.

FIG. 1A shows the substrate 10 with the protective layer 14 overlying surface structures 11, 12. A layer of amorphous or polycrystalline silicon mold material 13 has been formed, as for example by plasma enhanced chemical vapor deposition (PECVD), as is known in the art on the substrate. It is understood that other materials may be used for the mold material, such as metals, polymers, or dielectrics, or a combination of layers of different materials may be used. The protective layer 14 is a layer of silicon nitride deposited by PECVD, and may be optional, depending on the materials and processes used. The protective layer does not have to be silicon nitride. Other materials may be suitable depending on what needs to be protected, and what the subsequent steps, particularly the etch steps, are. In this instance, the thickness of the protective layer is about one tenth the thickness of the layer of mold material, which is about 10 microns thick. The mold material may be thinner or thicker, depending on the desired mold, subject to the practical limits of the layer-forming process. The thickness is chosen according to the desired shape of the nozzle, including its aspect ratio, and the lateral dimension of the nozzle and/or associated chamber. For example, the mold material could be up to 100 microns thick given sufficient deposition time.

FIG. 1B shows the substrate 10 with a layer of photoresist 15 on the layer of mold material 13. The photoresist is exposed to light through a photomask and developed to open windows 16 in the photoresist. In this instance, an array of photoresist disks 17 are formed, as shown in FIG. 1I. It is understood that other photoresist patterns, such as rectangles or ovals could be used. A positive-type photoresist provides smaller geometries with less clean-up during the photoresist strip process, and is formed on the mold material using conventional methods.

The resist pattern is formed according to the desired mold shape. For example, if an ink-jet print head capable of producing 600 dots-per-inch is desired, the nozzle openings would be spaced about 40 microns apart on their center lines. The diameter of the nozzle openings would typically be less than the center-to-center spacing and may also vary according to the type of ink or other fluid to be used with the print head.

As an alternative to using photoresist as the etch mask material, a different material may be used to define an etch mask on the mold material. For example, a layer of metal or other resist material (not shown) may be formed over the mold material and patterned according to conventional methods, as are known in the art. Such an alternative etch mask material may provide superior masking qualities, depending on the chosen mold material and etch chemistry.

Figure 1D:
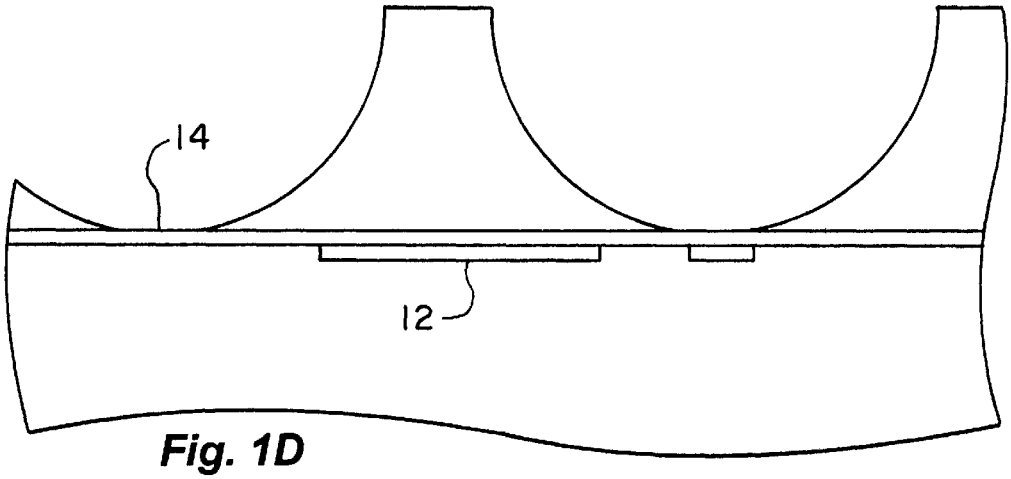

FIG. 1C shows the mold material 13 after the substrate has been isotropically etched in an isotropic dry etcher using a remote plasma system (RPS), such as an RPS™ chamber used in conjunction with a 5000™ System or CENTURA System, both sold by Applied Materials, Inc., of Santa Clara, Calif. A plasma formed from carbon tetrafluoride and diatomic oxygen is suitable for this etch process, although there are other suitable precursors. The mold material is etched down to the protective layer 14 in a controlled fashion to expose the desired amount of the protective layer or to expose the underlying surface feature 12. This is known as an "overetching" step. The amount of overetching depends upon the thickness of the nozzle material layer, the spacing between adjacent nozzles or other features, and the final mold shape, among other factors. After this mold-forming step is complete, the remaining photoresist 15 is removed, as shown in FIG. 1D.

The isotropic RPS etch removes a material essentially equally in all directions. The RPS etch provides superior wafer uniformity, repeatability, selectivity between materials, and controllability compared to other processes, such as a wet chemical etch. These characteristics of RPS etching allow producing molds, and hence nozzles, with more uniform and smaller geometries. The technique of forming small, precisely dimensioned nozzles allows for reducing the geometry of the nozzles and for increasing the density of the nozzles so that higher resolution printing is possible.

Figure 1E:
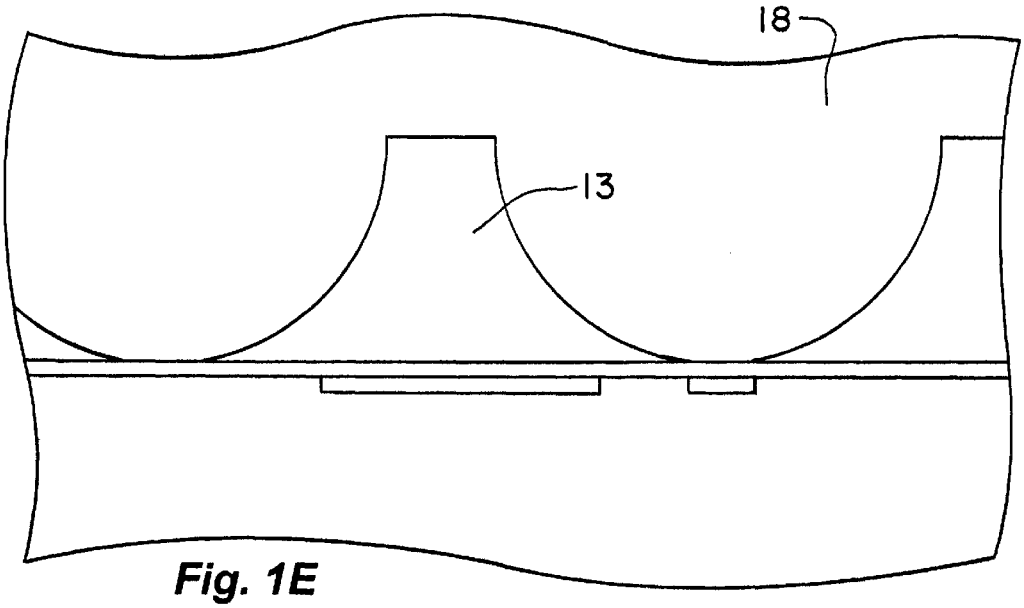
Figure 1I:
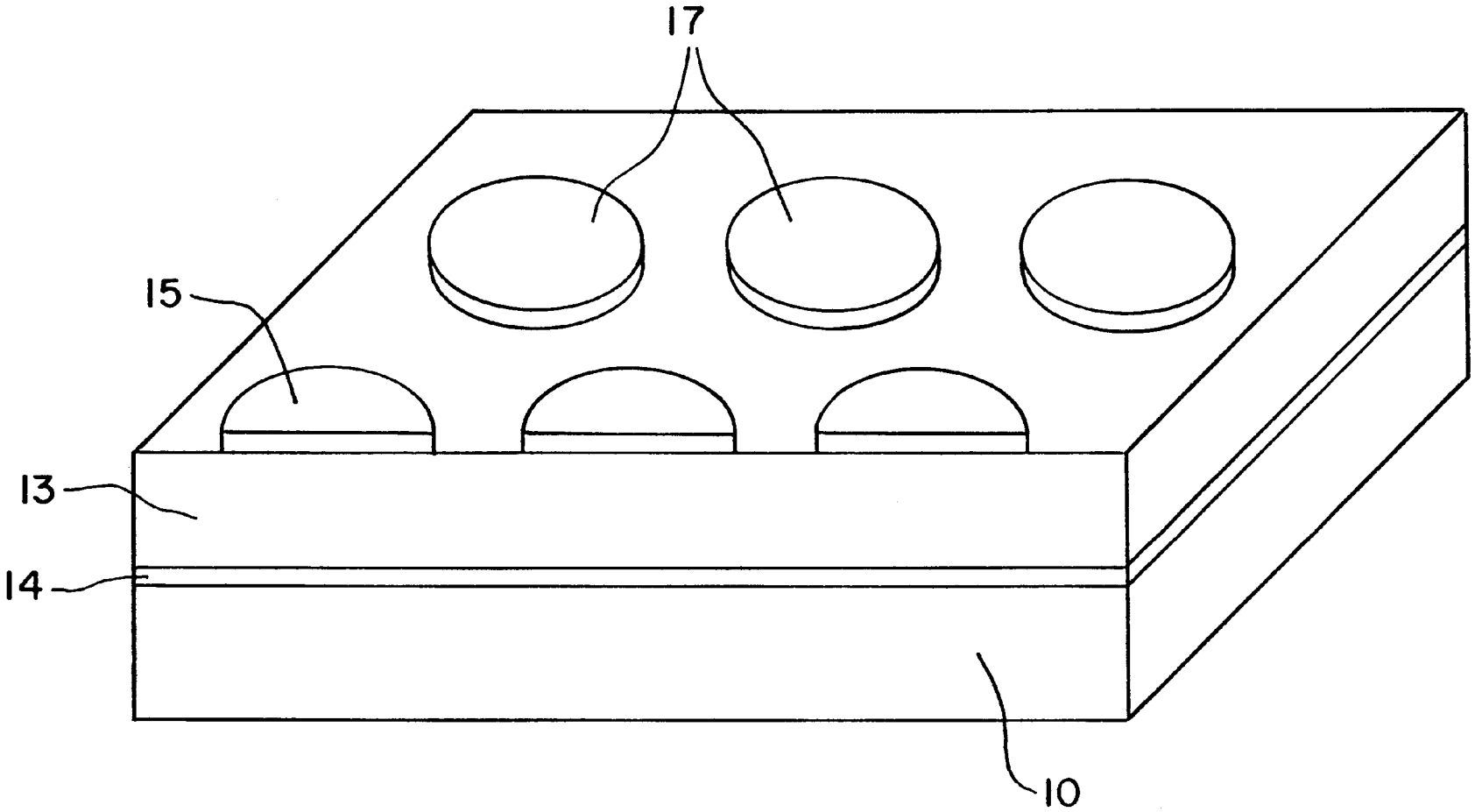
FIG. 1I is a simplified isometric view of a photoresist pattern on a layer of mold material on a substrate.
Figure 1J:
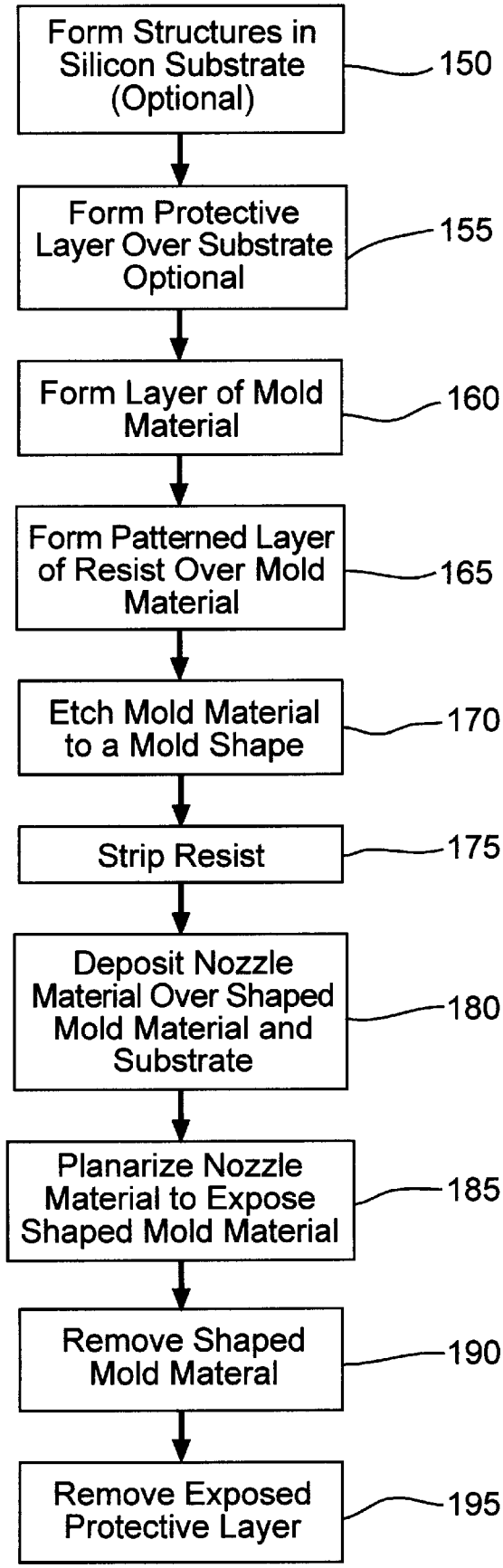
FIG. 1J is a flow chart representing a process sequence consistent with the cross sections shown in FIGS. 1A–1H.

FIG. 1E shows a layer of nozzle material 18 formed over the shaped mold material 13. In this instance, the layer of nozzle material is a conformal layer of silicon oxide deposited by PECVD from suitable precursors, such as ozone and tetraethylorthosilane (TEOS) or silane and oxygen. It is understood that the nozzle material layer could be formed from silicon oxide using other methods, such as sub-atmospheric CVD, or could be formed from other materials, such as spin-on-glass (SOG), bias sputtered aluminum oxide, metal, semiconductor, or intermetallics. The nozzle material layer could also be a composite of different layers of materials.

FIG. 1F shows the nozzle material layer 18 after it has been planarized to expose the nozzle mold material 13. Many techniques may be used to planarize the substrate, such as plasma etching, resist planarization, SOG planarization, or chemical-mechanical polishing. It is not necessary to expose the mold material in the planarization step, as a portion of the nozzle material could be removed in a subsequent patterned etch step. For example, photoresist could be patterned on the nozzle material and an aperture, or several apertures, could be etched through the nozzle material to the mold material. An example of this technique is discussed in further detail below, in relation to FIG. 5D.

FIG. 1G shows the substrate after the mold material has been etched away. An RPS technique that selectively etches the mold material without significantly etching the protective layer or the nozzle material leaves nozzle-shaped voids 19 in the nozzle material layer 18. For example, a plasma formed from a precursor gas including hydrogen bromide, diatomic chlorine, and diatomic oxygen could be used. A different precursor gas than was used for the mold-shaping etch process, described above in conjunction with FIG. 1C, is appropriate because of the different etch selectivities involved. Specifically, the nozzle material was not present in the mold-forming process, allowing the use of a different precursor gas. Of course, some combinations of materials would allow a single precursor gas to be used for both steps.

While the RPS process provides excellent uniformity and efficiency, it is understood that a wet-chemistry etch that is selective between the nozzle material and the mold material could also be used. However, plasma-etch techniques, unlike wet-chemical techniques, provide in-situ process monitoring to determine the endpoint of an etch step. For example, the atomic composition of the plasma may be monitored to detect when elements of the substrate are present in the plasma, indicating that etching of the substrate has begun. At that point, the etch process may be ended, or overetching may continue for a period of time. It is understood that some etch processes exhibit a high degree of etch selectivity between materials, such as between the mold material and the substrate material, and that high selectivity may further reduce the need for a protective layer, or may be used to further control the shape of the void.

If a protective layer 14 has been used, it may be necessary to remove this layer to expose the surface structures 12 underneath the nozzles. An RPS etch technique that selectively etches the protective layer material without significantly etching the nozzle material 18 or the surface structures 12 is appropriate for this step. Alternatively, a non-selective etch may be used with an end-point detector, as described above, or a solution of hot phosphoric acid may be used.

The protective layer etch process does not have to be selective between the protective layer material and the nozzle material or the surface structure material if the protective layer is so thin that removing it with a non-selective etch does not significantly affect the other materials. FIG. 1H shows the cross section of the substrate with the completed nozzle 19.

FIG. 1J is a general flow chart illustrating the process described in conjunction with FIGS. 1A–1H. The flowchart denotes a number of steps as optional. For example, a step 150 of forming structures in a substrate of silicon material is indicated as optional since the technique for forming such a nozzle structure is applicable whether or not there are structures formed in or on the substrate. Thus, there may be no need to form structures. The result of this step was described above in connection with the paragraph generally discussing FIGS. 1A–1H. A step 155 of forming a protective layer over the substrate is also optional, as described above in connection with FIG. 1A.

A step 160 of forming a layer of mold material on the substrate was described above in connection with FIG. 1A. A step 165 of forming a patterned layer of resist over the mold material was described in connection with FIGS. 1B and 1I. A step 170 of etching the mold material into a mold shape is described above in connection with FIG. 1C, and a step 175 of stripping the resist is described in connection with FIG. 1D.

A step 180 of depositing nozzle material over the shaped mold material is described in connection with FIG. 1E. The nozzle material is planarized in a step 185, as described in connection with FIG. 1F. The step 185 of planarization exposes the shaped mold material, allowing a step 190 of removing the mold material, thus exposing the protective layer, as described above in connection with FIG. 1G. A step 195 of removing the protective layer, if present, was described above in connection with FIG. 1H.

Figure 2A:
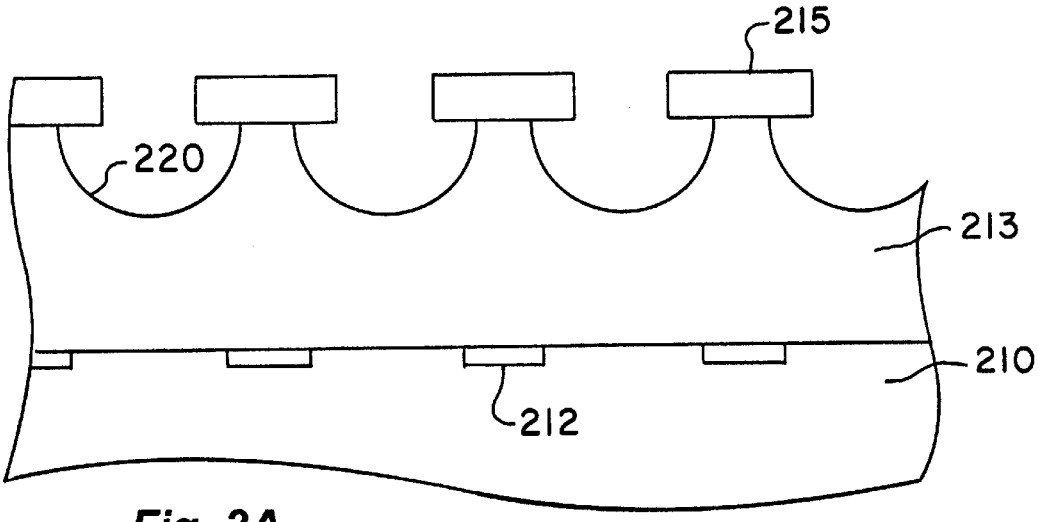
FIGS. 2A and 2B are simplified cross sections of a nozzle mold being formed on a substrate according to another embodiment of the present invention after selected steps of a method using isotropic and anisotropic etch steps.

FIG. 2A shows a cross section of a partially formed mold according to another embodiment of the present invention. A layer of mold material 213 has been formed on a substrate 210. A layer of photoresist 215 has been patterned and some of the mold material has been removed with an isotropic etch process, as described above. This leaves convex cusps 220 in the mold material 213 that will result in a convex sidewall of the eventual chamber or nozzle. Next, an anisotropic etch step, such as a reactive ion etch (RIE) performed with an M×P+ CENTURA System, sold by Applied Materials, Inc., of Santa Clara, Calif., etches mold material not covered by the photoresist. Unlike anisotropic etches that depend upon the orientation of a single crystal, an RIE anisotropic etch may be performed on amorphous, polycrystalline, or monocrystalline material. The anisotropy arises from the configuration of the etch system, with the resist forming a protective cover that contributes to defining the resulting shape.

Figure 2B:
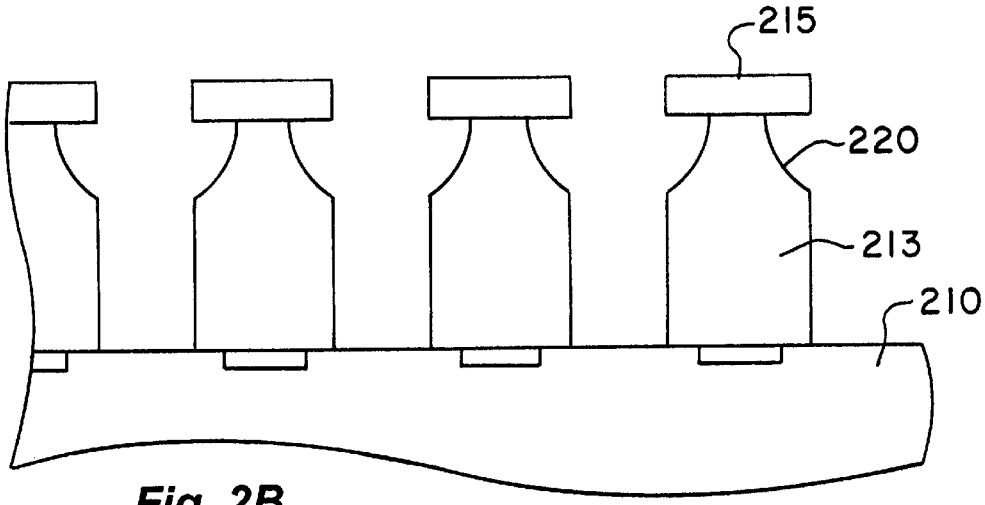
Figure 2C:
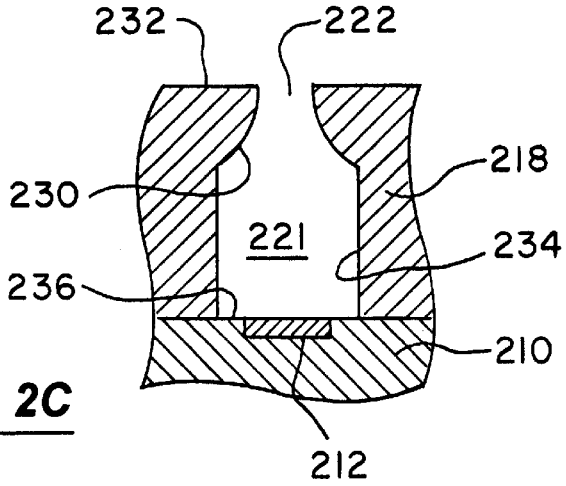
FIG. 2C is a simplified cross section of a nozzle on a substrate formed according to the method described in conjunction with FIGS. 2A and 2B.

FIG. 2B shows the resultant mold shape. The patterned photoresist 215 shadows the mold material 213 beneath the photoresist so that the mold material is etched essentially straight down to the substrate 210. FIG. 2C shows the final chamber 221 and aperture 222, or nozzle, shape in a layer of nozzle material 218 with a convex sidewall 230 intersecting a top surface 232 of the nozzle material. The chamber has straight sidewalls 234 and a backwall 236. The combination of an isotropic etch followed, in this instance, by an anisotropic etch produces a chamber with a large volume and straight-sided walls. Additionally, the nozzle radius is less than would result from a comparable process as-described in relation to FIGS. 1A–1H. The combination of straight-sided walls and a narrow aperture with a small radius may transfer energy more efficiently from a surface structure 212, such as an ink driver, through the aperture 222 when expelling ink.

FIGS. 3A–3C show simplified cross sections of a mold being formed according to another embodiment of the present invention. After patterning a layer of photoresist 315 on a layer of mold material 313, an anisotropic etch step is performed to etch straight-sided channels 323 in the mold material. An isotropic etch step deepens and widens the channels, and forms a radius 324 in the mold material. A second anisotropic etch step clears the mold material through to the substrate 310. The resultant mold shape will eventually produce a void in a layer of nozzle material with straight walls, a small nozzle radius, and a long aperture "throat" 325.

From the examples given above, it can be seen that combining an anisotropic etch, such as can be performed in an M×P+ CENTURA system chamber, with an isotropic etch, such as can be performed in an RPS™ chamber, may result in a variety of void shapes. Specifically, by combining or alternating these etch processes, one may vary the vertical and horizontal etch characteristics when removing mold material under a photoresist cap. Providing an anisotropic etch prior to an isotropic etch, for example, may result in a relatively greater vertical etch characteristic. Providing a relatively greater vertical etch characteristic may be appropriate for smaller geometries, such as when the mold material layer is less than 10 microns thick or when the nozzle aperture is less than 20 microns across.

Figure 4A:
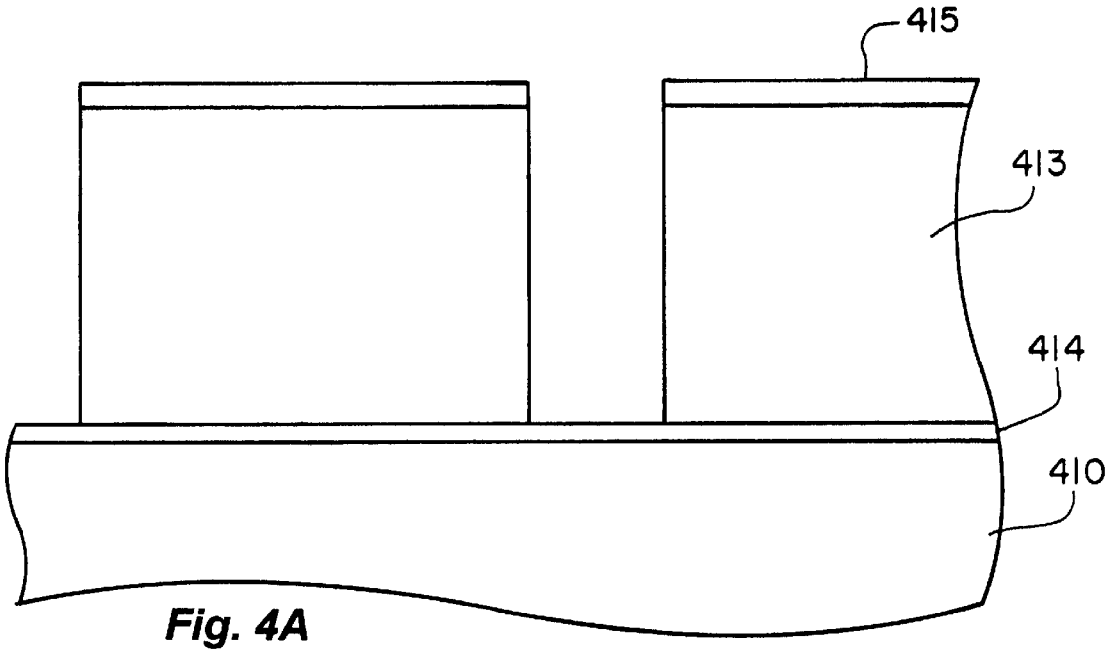
FIGS. 4A–4C are simplified cross sections of a nozzle mold being formed on a substrate according to another embodiment of the present invention using a sputter etching step.
Figure 4B:
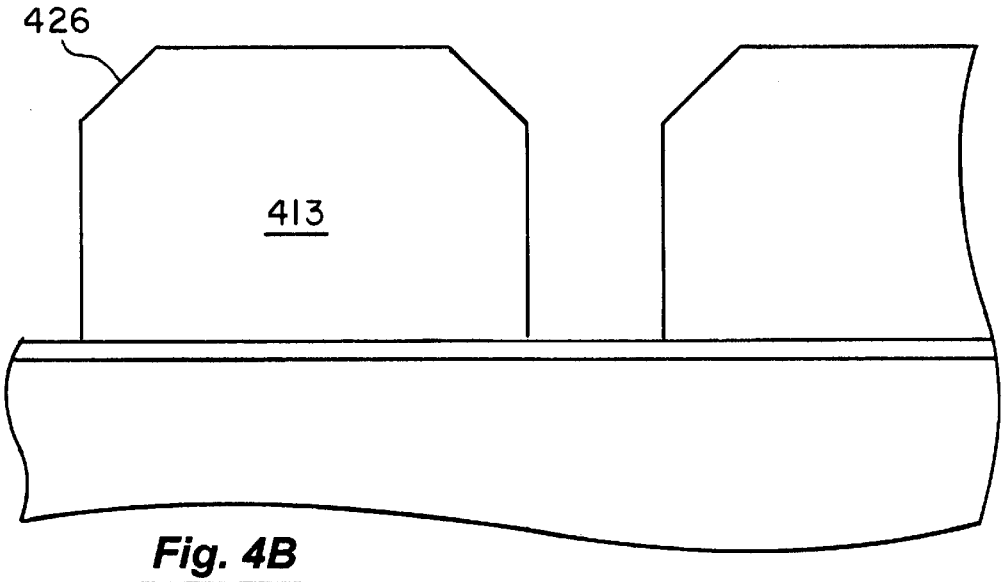
Figure 4C:
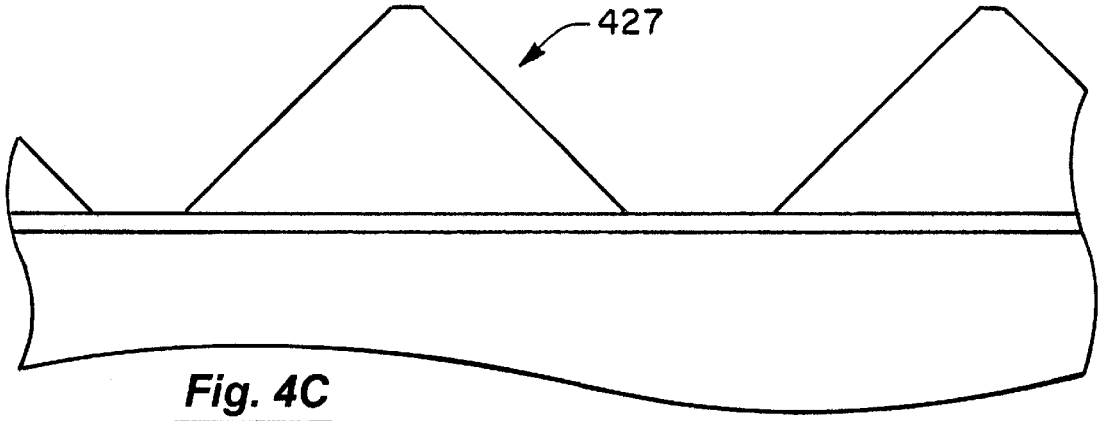

FIGS. 4A–4C show simplified cross sections of a mold being formed according to another embodiment of the present invention. A layer of mold material 413 has been formed on a protective layer 414 on a substrate 410. Photoresist 415 has been formed and patterned, and an anisotropic etch has been performed to leave, for example, a cylinder of mold material with a photoresist cap on the protective layer, as shown in cross section in FIG. 4A. After removing the photoresist cap, the mold material is sputter etched. The sputter etch rate is anisotropic, being dependant on the surface angle of the material, and is higher at the exposed corners of the cylinders, as is known in the art. This results in forming facets 426 on the mold material. Sputter etching is continued until a conical mold shape 427 is obtained. Alternatively, a conical-top mold with straight sidewalls will result by proper selection of the diameter and height of the starting cylinder of mold material. In other words, it is possible to form a conical top to the cylinder of mold material before the cone walls intersect the protective layer or the substrate. A repeatable and uniform conical shape is possible because of repeatability and controllability of the sputter etch process. A process similar to that described above in conjunction with FIGS. 1A–1H may then be used to complete the formation of a nozzle.

FIGS. 5A–5D relate to yet another alternative embodiment of the present invention. In FIG. 5A, a first layer of mold material 513 has been deposited on a substrate 510 and a photoresist layer 515 has been patterned to form disks on the first layer of mold material, similar to those shown in FIG. 1I. The first layer of mold material has been anisotropically etched down to the substrate, leaving cylinders 517 of first mold material with photoresist caps.

FIG. 5B shows the photoresist caps having been removed, and a second, conformal, layer of mold material 513 deposited over the cylinders formed from the first mold material. As seen, this second layer of mold material forms a continuous layer of smooth bumps.

The composite layer of mold material is then isotropically etched, preferably using an RPS etch. If the first layer of mold material and the second layer of mold material etch at essentially the same rate, the isotropically etching of the composite layer of mold material results in the smooth, essentially hemispherical molds 530 shown in FIG. 5C.

FIG. 5D is a simplified cross section of nozzles in a layer of nozzle material 518. The chamber 531 was formed in the layer of nozzle material by process steps similar to those described above in conjunction with FIGS. 1E–1H. It is particularly noted that the layer of nozzle material 518 was not planarized to expose the hemispherical molds, although it could have been. Nozzle material overlying the molds was etched in a patterned fashion to open apertures to expose the mold material. This results in a hemispherical chamber with a reasonably thick wall 532 surrounding the aperture 533. This may provide superior strength and wear characteristics compared to a similar aperture formed by planarizing the nozzle material to expose the mold material. This aperture could be further modified, such as by sputter etching to provide a counter-sunk facet, as could the apertures described above.

While the above is a complete description of specific embodiments of the present invention, various modifications, variations, and alternatives may be employed. For example, different mold materials and nozzle materials may be used to provide different etch selectivities, or for compatibility with different inks or other fluids, such as chemical reaction products, polymeric or catalyst materials, or biological compounds. Different mold or nozzle material layers also may be combined to further modify the shape of the void, or to provide enhanced nozzle characteristics, such as durability. For example, a mold layer comprised of multiple layers of different materials with different etch selectivities may produce a stepped mold shape. Furthermore, different combinations of etch processes may be used, such as combining an isotropic or anisotropic plasma etch step with a wet chemical etch step. Other variations will be apparent to persons of skill in the art. These equivalents and alternatives are intended to be included within the scope of the present invention. Therefore, the scope of this invention should not be limited to the embodiments described, and should instead be defined by the following claims.

What is claimed is:

1. A method for forming a chamber in a layer on a substrate, the method comprising the steps of:

a) forming a first layer on the substrate;

b) shaping material in the first layer into a mold shape using an etch technique;

c) forming a second layer over the substrate and the mold shape;

d) exposing at least a portion of the mold shape; and e) removing the mold shape to define a chamber in the second material.

2. The method of claim 1 wherein the first layer comprises silicon.

3. The method of claim 1 wherein the second layer comprises a ceramic.

4. The method of claim 3 wherein the ceramic comprises a silicon oxide.

5. The method of claim 1 wherein the first layer has a thickness less than about 100 microns.

6. The method of claim 1 wherein the shaping in step 1(b) includes forming a resist cap on the first layer and etching material in the first layer.

7. The method of claim 6 wherein the etching of material in the first layer includes an anisotropic etch step and an isotropic etch step.

8. The method of claim 7 wherein the isotropic etch step comprises etching with a plasma produced in a remote plasma source.

9. The method of claim 7 wherein the anisotropic etch step comprises etching with a biased plasma.

10. The method of claim 1 wherein step l(d) of exposing is done by planarizing the second layer.

11. The method of claim 1 further comprising etching at least a portion of a protective layer, the protective layer being disposed between the first layer and the second layer.

12. The method of claim 1 wherein the substrate includes an ink driver.

13. The method of claim 12 wherein the substrate further includes integrated control circuitry.

14. A method for forming a nozzle structure, the method comprising the steps of:

(a) forming a first layer on a substrate;

(b) forming a photoresist layer on the first layer;

(c) patterning the photoresist layer;

(d) isotropically etching material in the first layer to expose at least a portion of an etch-stop layer, the etch-stop layer being disposed between the substrate and the first layer;

(e) removing the photoresist layer;

(f) forming a second layer over the material in the first layer and the exposed etch-stop layer;

(g) planarizing second material in the second layer to expose at least a portion of the material in the first layer;

(h) removing the material in the first layer to define a chamber in the second material; and (i) removing at least a portion of the etch-stop layer to expose at least a portion of the substrate.

15. The method of claim 14 wherein the second material comprises ceramic.

16. The method of claim 15 wherein the ceramic comprises silicon oxide.

17. The method of claim 14 wherein the substrate is a silicon wafer.

18. The method of claim 14 wherein the etch-stop layer comprises silicon nitride.

19. A method for forming a nozzle structure, the method comprising the steps of:

(a) forming a first layer of a first material on a substrate;

(b) patterning the first material of the first layer;

(c) forming a second layer of a second material over the first material of the first layer, wherein the second layer is a conformal layer;

(d) isotropically etching the first material and second material of the first and second layers into a shape to expose at least a portion of the substrate;

(e) forming a third layer on the shape and on the exposed portion of the substrate;

(f) exposing at least a portion of the shape through an aperture in the third material; and (g) removing the material and second material to leave a chamber in the layer of third material.

20. The method of claim 19 wherein an etch-stop layer is disposed between the substrate and the first or second layer.

21. The method of claim 19 wherein the substrate is a silicon wafer.

22. The method of claim 19 wherein step 18(f) of exposing at least a portion of the shape is done by etching through a defined portion of the third material.

23. The method of claim 19 wherein the material of both the first and second layers comprise silicon.

24. The method of claim 19 wherein the shape is a hemisphere.

25. A method for forming a nozzle structure, the method comprising the steps of:

(a) forming a layer of mold material on a substrate;

(b) patterning a photoresist layer on the layer of mold material to expose at least a portion of the mold material;

(c) anisotropically etching the exposed mold material to expose at least a portion of the substrate and to form a first shape of mold material;

(d) removing the photoresist layer;

(e) sputter-etching the first shape of the mold material to form a facet on the mold material;

(f) forming a layer of nozzle material over the mold material and the substrate;

(g) exposing at least a portion of the mold material through an aperture in the nozzle material; and (h) removing the mold material to define a chamber in the nozzle material.

26. A method for forming a chamber in a layer on a substrate, the method comprising the steps of:

a) forming a first layer on the substrate, the first layer having a thickness of less than 100 $\mu$m;

b) shaping material in the first layer into a mold shape;

c) forming a second layer over the substrate and the mold shape;

d) exposing at least a portion of the mold shape; and e) removing the mold shape to define a chamber in the second material.

* * * * *